United States Patent [19]

Krober et al.

[11] 4,316,596

[45] Feb. 23, 1982

[54] POWER ACTUATED VALVE

[76] Inventors: Hubert D. Krober, P.O. Box 338, Cheyenne, Okla. 73628; Thomas Kelly, 1729 Westminster Pl., Oklahoma City, Okla. 73120

[21] Appl. No.: 26,340

[22] Filed: Apr. 2, 1979

[51] Int. Cl.[3] ..... F16K 31/122; F16K 31/53

[52] U.S. Cl. ..... 251/58; 74/346; 74/350; 175/218; 251/249.5

[58] Field of Search ..... 74/346, 350, 424.8 VA; 175/218; 251/58, 248, 249.5

[56] References Cited

U.S. PATENT DOCUMENTS

| | | | |
|---|---|---|---|
| 473,918 | 5/1892 | Douglass | 175/214 |
| 1,784,094 | 12/1930 | Fletcher | 251/248 |
| 1,874,889 | 8/1932 | Burris | 166/79 |
| 1,998,886 | 4/1935 | Scheid | 251/11 |
| 2,251,633 | 8/1941 | Panish | 74/424.8 VA |
| 2,346,681 | 4/1944 | Harper | 74/346 |
| 2,357,952 | 9/1944 | Hoelscher | 74/346 |
| 2,398,997 | 4/1946 | Berry et al. | 74/346 |
| 2,835,136 | 4/1958 | Berthiez | 74/346 |
| 3,034,371 | 5/1962 | Cantalupo et al. | 74/424.8 VA |
| 3,036,590 | 5/1962 | Knox | 137/315 |
| 3,151,837 | 10/1964 | Bentley-Leek | 251/214 |
| 3,398,928 | 8/1968 | Fredd | 251/251 |
| 3,631,945 | 1/1972 | Ollearo | 74/346 |
| 3,665,995 | 5/1972 | Conner, Sr. | 251/133 |
| 3,729,170 | 4/1973 | Lewis et al. | 251/315 |
| 3,806,082 | 4/1974 | Kellner | 251/58 |
| 3,847,372 | 11/1974 | Litchfield | 175/218 |
| 3,941,348 | 3/1976 | Mott | 251/58 |
| 4,082,247 | 4/1978 | Dalton | 74/424.8 VA |

OTHER PUBLICATIONS

"Oil Field Power Tools"–International Tool Company, Inc., pp. 1–7, Model A-6B-Kelly-Spinner.

*Primary Examiner*—George L. Walton

*Attorney, Agent, or Firm*—Laney, Dougherty, Hessin & Beavers

[57] ABSTRACT

A power actuated kelly valve includes a cylindrical valve body having a valve member disposed therein with a first gear attached to said valve member. A second gear is provided for drivingly engaging said first gear to operate said valve member. A support member is attached to the valve body, and a first frame is rotatingly connected to the support member so that the valve body may rotate relative to the first frame. A moving apparatus is connected between the first frame and a second frame. The moving apparatus provides apparatus for selectively moving the second gear into and out of engagement with the first gear. A locking device is provided for selectively locking the first frame to the support member to prevent the first frame from rotating relative to the valve body when the locking device is in the locked position. A control apparatus is operatively associated with the moving apparatus and the locking device, for causing the locking device to be moved to the locked position at the same time at which the second gear is in engagement with the first gear. A power drive is attached to the first frame. A third gear is attached to the second gear, said third gear engaging a fourth gear which is attached to the power drive, so that the power drive drives the second and third gears.

21 Claims, 6 Drawing Figures

POWER ACTUATED VALVE

BACKGROUND OF THE INVENTION

1. Field of the Invention

This invention relates generally to valves having a powered actuator, and more particularly, but not by way of limitation, to a powered actuator for a kelly valve of a rotary drilling rig for oil wells and the like.

2. Description of the Prior Art

A particular application of the present invention is for the power actuation of an upper kelly cock valve in a standard rotary drilling rig for oil wells. The kelly valve is typically a 90° operating valve such as a butterfly valve or ball valve, with that 90° valve member generally being located inside a cylindrical valve body. The valve body and valve member are generally known as the kelly. The kelly or kelly joint as it is sometimes called is connected below the swivel on a drilling rig and is connected to the drill string tubing. The kelly valve therefore rotates with the drill string tubing as the oil well is being drilled. The purpose of the kelly valve is to shut off the pressure from inside the drill string tubing.

Generally kelly valves of the prior art have merely had a manually operated valve member. The problem which is frequently encountered, however, is that during emergency conditions, such as when a blowout is imminent or in process, it is very dangerous to have a workman ascend the drilling derick in order to manually shut off the kelly valve.

The present invention is directed towards a powered actuator for such a kelly valve. The primary difficultly being that the actuator must be so constructed that it allows the kelly valve to rotate within the actuator device during normal drilling operations, and at the same time provides the capability for engaging the kelly valve to actuate the valve member and close the valve when it is necessary to do so.

The present apparatus is particularly useful in deep wells deeper than 9,000 feet where the pressures encountered in the formation greatly increase the danger of blowout.

One prior art device is known which has provided a powered actuator for a kelly valve. The apparatus is manufactured by International Tool Company, Inc. and is illustrated in a brochure entitled "OIL FIELD POWER TOOLS" published by International Tool Company, Inc. That power actuated kelly valve apparatus is designated by the trademark REMO-TROL and is best illustrated on page 3 of that brochure. It is apparent upon an examination of the description of the International Tool Company, Inc. device in its brochure, that the construction of that device is very different from the present invention. The International Tool Company device uses a pair of pinion gears attached to the valve member, said pinion gears each engaging one of a pair of straight rack gears. As is apparent from the illustrations on page 3 of the brochure, the rack gears remain in contact with the pinion gears at all times regardless of the position of the valve member.

SUMMARY OF THE INVENTION

A power actuated kelly valve includes a cylindrical valve body having a valve member disposed therein with a first gear attached to said valve member. A second gear is provided for drivingly engaging said first gear to operate said valve member. A support member means is attached to the valve body, and a first frame means is rotatingly connected to the support member means so that the valve body may rotate relative to said first frame means. A moving means is connected between said first frame means and a second frame means. The second gear means is rotatingly mounted within the second frame means. The moving means provides a means for selectively moving said second gear means into and out of engagement with said first gear means. Locking means is provided for selectively locking the first frame means to the support member means to prevent the frame means from rotating relative to the valve body when the locking means is in the locked position. A control means is operatively associated with the moving means and the locking means, for causing the locking means to be moved to the locked position at the same time at which the second gear means is in engagement with the first gear. Power drive means are attached to the first frame means. A third gear means is attached to the second gear means, said third gear means engaging a fourth gear means which is attached to the power drive means, so that the power drive means drives the second and third gear means.

It is a general object of the present invention to provide an improved powered actuator for a valve.

Another object of the present invention is the provision of a power actuated valve which has the capability of permitting the valve to rotate relative to the actuating device.

Another object of the present invention is the provision of an actuator having a means for selectively moving first and second gear means into and out of engagement with each other, with one of said gear means being attached to a valve member which valve member is free to rotate relative to a frame in which the other of said gear means is mounted.

Other and further objects, features and advantages of the present invention will be apparent to those skilled in the art upon a reading of the detailed description in combination with the drawings.

DETAILED DESCRIPTION OF THE EMBODIMENTS

Figure 1:
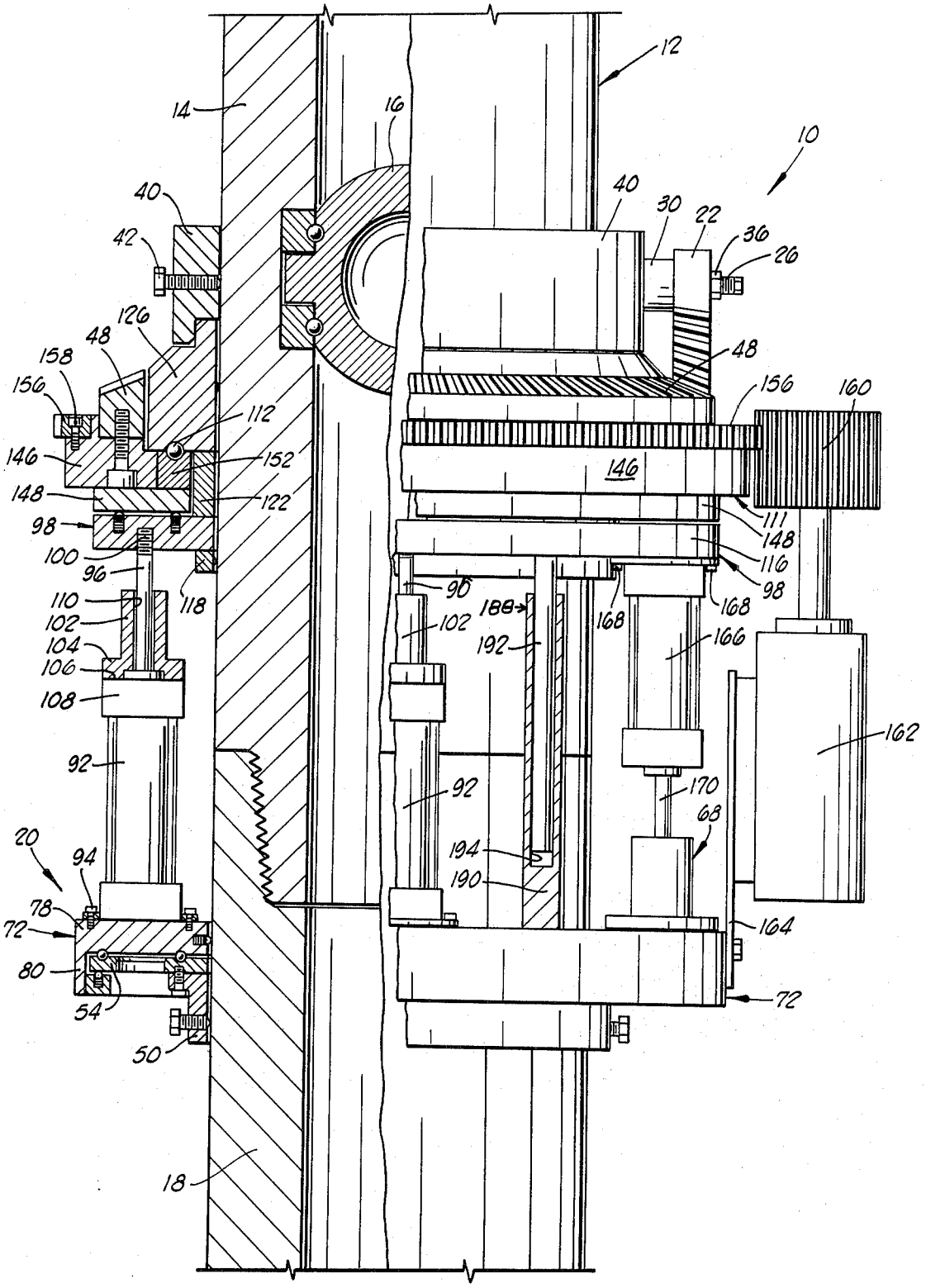
FIG. 1 is an elevational view of the power actuated valve assembly of the present invention which is shown partly in section.

Referring now to the drawings and particularly to FIG. 1, the power actuated valve assembly of the present invention is shown and generally designated by the numeral 10. A valve 12 includes a cylindrical axially extending valve body 14 within which is located a rotatable valve member 16. Connected to valve body 14 is a valve body extension 18 which is also referred to as the sub 18.

The sub 18 is merely a cylindrical extension of valve body 14 and may be considered a part thereof. This extension is necessary in order to provide a means for attachment of the valve actuator, generally designated by the numeral 20, to valve body 14 and its extension 18.

The valve 12, including the valve body 14 and valve member 16, is a conventional kelly valve which is known to the prior art.

Figure 2:
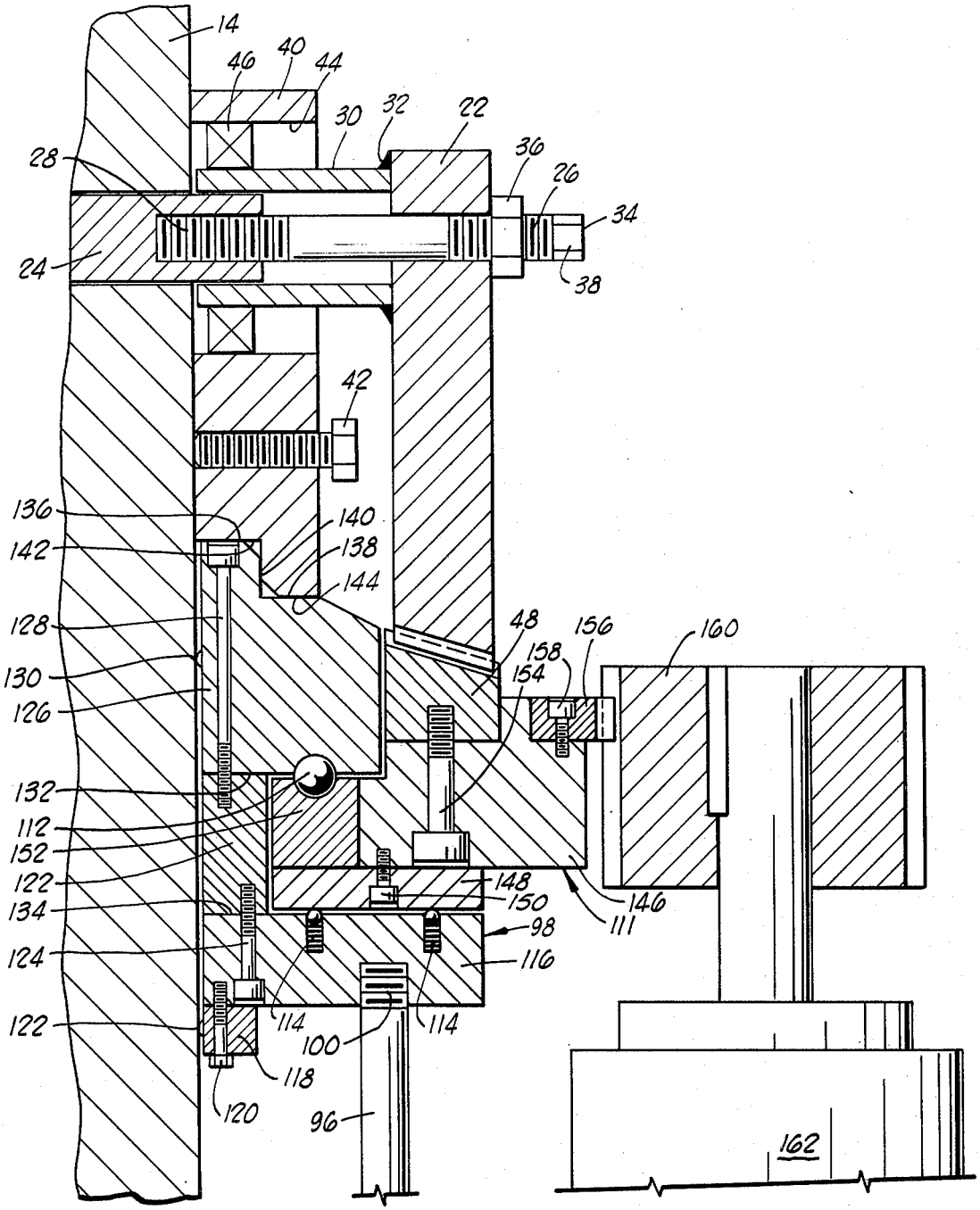
FIG. 2 is a sectional elevation view of a portion of the valve assembly of FIG. 1 illustrating the manner of construction of the gear connected to the valve member and the driving gear powered by the hydraulic motor.

A first gear means 22 is attached to rotatable valve member 16. The manner of this attachment is best seen in FIG. 2. A male hexhead extension 24 is attached to valve member 16. A stud bolt 26 includes a first end 28 which is threadedly engaged with a tapped hole in hexhead extension 24. A conventional hex socket 30 is welded to first gear means 22 as indicated at 32.

Gear 22 and socket 30 are fitted over a second end 34 of stud bolt 26 so that socket 30 engages hexhead extension 24. A lock nut 36 holds first gear 22 in place upon stud bolt 26. The second end 34 of stud bolt 26 also includes a wrench flats 38 so that the valve member 16 may be manually operated if necessary.

First gear means 22 is a sector gear which comprises approximately a 90° angle.

A stop ring 40 is attached to valve body 14 by a plurality of locking bolts 42. Stop ring 40 includes a circular opening 44 through which stud bolt 26 and its associated components protrude. A bearing 46 is closely fit upon the outer surface of socket 30 and snugly fits within the inner surface of opening 44 when socket 30 is placed in engagement with male hexhead extension 24.

The first gear means 22 is a bevel gear means. A second gear means 48 is a bevel ring gear and is constructed for selective driving engagement with first gear means 22 so that when second gear 48 is engaged with first gear 22 the rotation of second gear 48 will in turn rotate first gear 22 which will operate valve member 16 to open or close the same.

Figure 3:
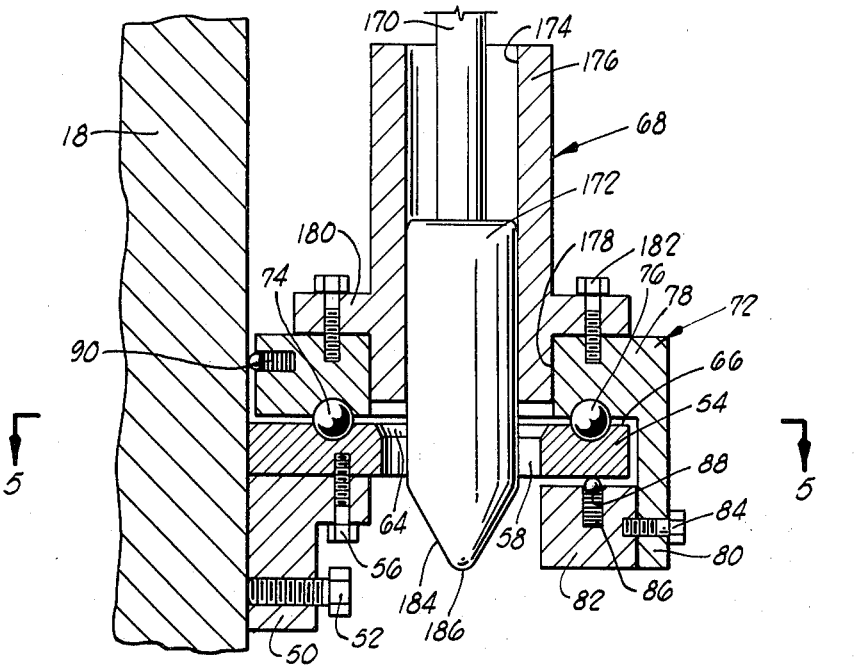
FIG. 3 is a sectional elevation view of a portion of the valve assembly of FIG. 1 illustrating the lower frame means rotatingly connected to the support means, and showing the locking means interconnecting the lower frame means and the support means.

Referring now to FIGS. 1 and 3 a support member means 50 is attached to valve body extension 18 by a plurality of locking bolts 52. Support member means 50 is an annular ring which is closely received about the outer surface of valve body extension 18. A locking ring 54 is attached to support member 50 by a plurality of machine screws 56.

Locking ring 54 includes a plurality of holes 58 disposed therein, said holes 58 being located on a circle 60 concentrically disposed about an axis of rotation 62 of support member means 50 and valve body extension 18.

Figure 5:
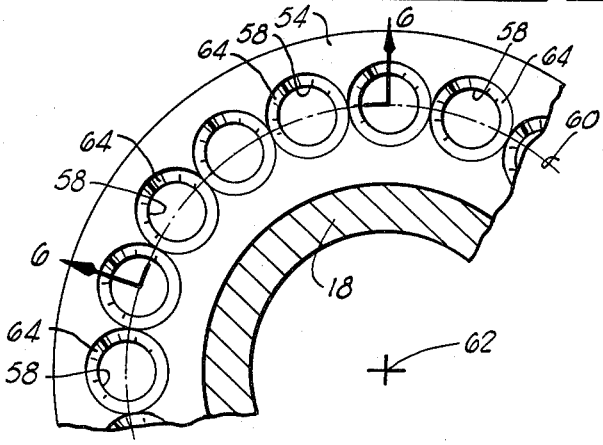
FIG. 5 is a sectional view taken along lines 5—5 of FIG. 3 illustrating an arcuate portion of the locking means.
Figure 6:
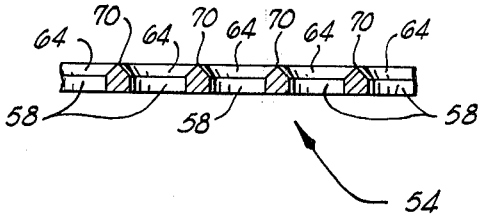
FIG. 6 is a sectional view taken along lines 6—6 of FIG. 5 showing a section of the locking ring in elevation.

As is best seen in FIGS. 5 and 6, the holes 58 in locking ring 54 each include a tapered edge 64 on the surface 66 of locking ring 54 facing upward toward locking means 68, which locking means is described in detail below. The tapered edges 64 of adjacent holes 58 intersect to form a peak 70.

A first frame means 72 is rotatingly mounted upon locking ring 54 by first and second concentric ball race means 74 and 76. This rotating connection permits valve body extension 18 and support member 50 to rotate relative to first frame means 72.

First frame means 72 comprises an annular plate 78 having a vertically downward extending annular skirt 80.

A back-up ring 82 is located concentrically within annular skirt 80 and is attached thereto by a plurality of screw fasteners 84. Back-up ring 82 includes a plurality of ball-checks 86 which provide a relatively friction free floating engagement of the balls 88 of ball-checks 86 with the lower surface of locking ring 54.

Similarly, a plurality of radially extending ball-checks 90 extend from the radially inner surface of annular plate 78 to engage the outer surface of valve body extension 18 to provide a relatively friction free engagement between first frame means 72 and valve body extension 18.

As is best seen in FIG. 1, a plurality of hydraulic lift cylinders 92 are attached to first frame means 72 by suitable fasteners 94. The hydraulic cylinders 92 include movable pistons 96 which are threadedly connected to a second frame means 98 at threaded ends 100 of pistons 96. There are four lift cylinders 92 equally spaced at angles of 90° about the annular first and second frame means 72 and 98.

Each of the hydraulic cylinders 92 includes a piston support means 102. The piston support 102 is merely a cylindrical member having a lower flange 104 which rests upon the top 106 of the outer casing 108 of cylinder 92. The piston support 102 includes an axial bore 110 within which the piston 96 is received. The piston support means 102 provides a lateral support to the pistons 96 when they are in their extended position as shown in FIG. 1, so that laterally imposed forces due to rotation of the various components will not bend the pistons 96.

The bevel ring gear 48 is attached to a ring gear carrier 111. The ring gear carrier 111 is in turn rotatingly mounted within second frame means 98 by a ball race means 112 and a plurality of ball-checks 114.

The hydraulic cylinders 92 provide a moving means for selectively moving the second bevel ring gear 48 into engagement with the first gear 22. In FIGS. 1 and 2 the pistons 96 are shown in their extended position so that the second frame means 98 is moved to its relatively upwardmost position with second gear 48 engaging first gear 22. To disengage second gear 48 from first gear 22, the pistons 96 are retracted so that first frame means 98 is lowered thereby lowering second gear 48 out of engagement with first gear 22. When first and second gears 22 and 48 are not engaged, the valve 12 is free to rotate relative to first and second frame means 72 and 98.

The second frame means 98 includes an annular plate 116 to which the pistons 96 are attached. A lower ring 118 is attached to annular plate 118 by a plurality of fasteners 120. Lower annular ring 118 carries a plurality of radially inward extending ball-checks 122 which allow second frame means 98 to float upon the outer surface of valve body 14. The ball-checks 114 upon which ring gear carrier 111 rotates are disposed in the upper surface of annular plate 116 as seen in FIG. 2.

Annular plate 116 is connected to a spacer ring 122 by a plurality of suitable fasteners 124.

Spacer ring 122 is in turn attached to an annular stop ring engaging ring 126 by a plurality of suitable fasteners 128. The ball race means 112 engages stop ring engaging ring 126. A plurality of radially inward extending ball-checks 130 are disposed in stop ring engaging ring 126 to further allow second frame means 98 to freely float upon the outer surface of valve body 14.

A lower surface 132 of stop ring engaging ring 126, and an upper surface 134 of annular plate 116 both extend radially outward past spacer ring 122 so as to form an annular groove within which ring gear carrier 111 is received.

Stop ring engaging ring 126 includes a first radially inner upper annular surface 136 and a second radially outer upper annular surface 138 connected by vertical surface 140. When second frame means 98 is moved into its radially upwardmost position illustrated in FIG. 2, with the second gear 48 engaging first gear 22, the stop ring engaging ring 126 engages stop ring 40 to limit the travel of second frame means 98 to prevent excessive upward force from being applied to second gear 48. The upper annular surfaces 136 and 138 of stop ring engaging ring 126 engage lower annular surfaces 142 and 144, respectively, of stop ring 40.

Of course, if other elements of the apparatus are appropriately designed, it is possible to eliminate the need for a stop ring engaging ring 126 to engage the stop ring 40. For example, the apparatus may be so designed so that the upper limit of movement of pistons 96 of lift cylinders 92 is reached at the same time as the second gear 48 meshes with the first gear 22. Similarly, if the upward forces exerted on second gear 48 by the lift cylinders 92 are not excessively high so that the gears 48 and 22 would be damaged, then no other movement limiting means other than engagement of the two gears 22 and 48 is needed.

The ring gear carrier 111 includes an aluminum gear holding ring 146 to the bottom of which is attached an annular steel plate 148 by a plurality of suitable fasteners 150. An inner steel ring 152 is press fitted within aluminum gear holding ring 146 and includes a bearing race of ball race means 112.

Second bevel ring gear 48 is connected to gear holding ring 146 by a plurality of suitable fasteners 154. A third gear means 156, which is a straight ring gear, is located concentrically outside of second gear 48 and is attached to gear holding ring 146 by a plurality of suitable fasteners 158.

Third straight ring gear 156 engages a straight pinion gear 160 which is a fourth gear means. Pinion gear 160 is drivingly attached to hydraulic motor 162 which is itself attached to first frame means 72 by mounting bracket 164. Hydraulic motor 162 and the gears 156 and 160 provide a power means for driving the second gear means 48. The straight pinion gear 160 has an axial tooth length sufficient to allow pinion gear 160 and straight ring gear 156 to remain meshed when second gear 48 is not engaged with first gear 22.

When the first and second gears 22 and 48 are engaged, as shown in FIGS. 1 and 2, so that valve member 16 may be operated by rotating second gear 48, it is necessary to lock first and second frame means 72 and 98 relative to valve body 14 so that the frame members 72 and 98 will not rotate relative to valve body 14 when hydraulic motor 162 drives the ring gear carrier 111.

The locking means 68 provides a means for selectively locking the first frame means 72 to the support member means 50 to prevent first frame means 72 from rotating relative to valve body 14 when locking means 68 is locked. The locking means 68 is best illustrated on the right hand side of FIG. 1 and in the detailed section of FIG. 3.

Locking means 68 includes a hydraulic locking cylinder 166 which is attached to second frame means 98 by suitable fasteners 168. A locking piston 170 extends downwardly from locking cylinder 166 and has attached to the lower end thereof a locking plunger means 172.

Plunger means 172 is closely received within an axial bore 174 of plunger guide cylinder 176. Plunger guide cylinder 176 is received in an axial hole 178 disposed through plate 78 of first frame means 72. Plunger guide cylinder 176 includes a radially extending flange 180 which abuts the upper surface of plate 78, and includes fasteners 182 connecting guide cylinder 176 to first frame means 72.

Plunger 172 includes a tapered locking ring engaging end 184 constructed so that engagement of tapered engaging end 184 with one of the tapered edges 64 of one of the holes 58 of locking ring 54 causes relative rotation between plunger 172 and locking ring 54 until said tapered engaging end 184 of plunger means 172 is received within one of said holes 58.

The tapered locking ring engaging end 184 is generally conically shaped with the lowermost point 186 being rounded. The rounded point 186 and the pointed peaks 70 between adjacent holes 58, are complementary in that, with even a slight bit of slack within this assembly, the rounded point 186 will tend to slide off the sharp peak 70 so that it is not possible for the point 186 to be lodged upon one of the sharp peaks 70. It is possible to invert these roles by constructing tapered engaging end 184 to have a sharp pointed end 186 and to construct the peaks 70 to be rounded rather than sharp. It is, however, preferrable not to have both the point 186 and the peaks 70 rounded, for that design would have more tendency to allow those two points to become lodged against each other.

A plurality of guide means 188 are attached between first and second frame members 72 and 98 to provide structural stability of the entire assembly of the first and second frame members 72 and 98 and the lift cylinders 92. Each of the guide means 188, as is seen in FIG. 1, includes a cylinder 190 attached to lower first frame means 72, and a sliding rod 192 attached to upper second frame means 98. The sliding rod 192 is slidingly received within an axial bore 194 of cylinder 190.

The entire actuator assembly 20 is generally enclosed by a sheet metal covering (not shown) attached to first frame means 72.

When the drilling rig to which the power actuated valve 10 is attached is in operation and the drill string is being rotated, the valve means 12 rotates with the drill string. During that normal operation the first and second gears 22 and 48 are not engaged. This allows valve 12 to rotate relative to actuator assembly 20. To prevent the actuator assembly 20 from rotating during this normal operation, such as might be caused by the drag of valve 12 engaging the ball-checks 90, 122 and 130, a restraining means (not shown) is generally provided to provide a slight lateral force to hold the actuator assembly 20 in place. The restraining means generally will consist of a flexible cable connected to first frame means 72 and also connected to some fixed structure such as the drilling derrick so as to provide the necessary lateral force.

Figure 4:
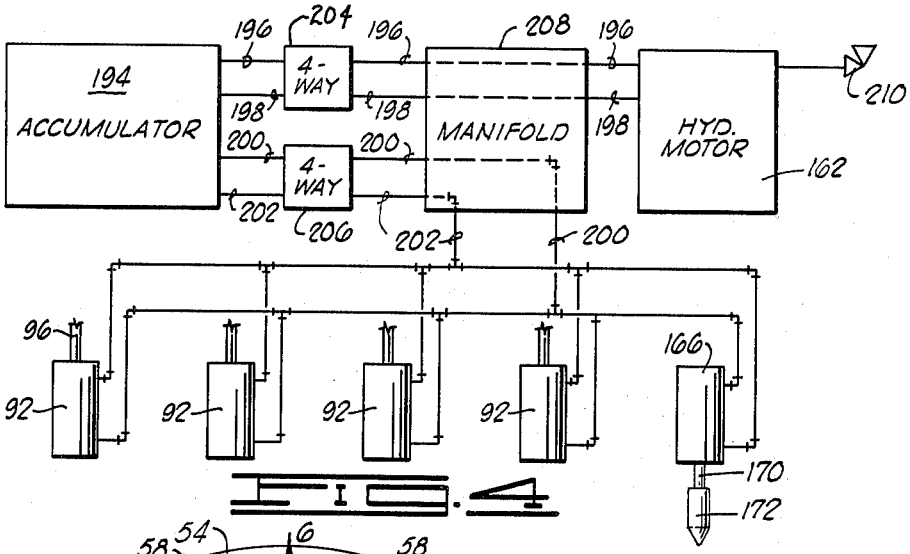
FIG. 4 is a schematic illustration of the hydraulic power system for the valve assembly of FIG. 1.

Referring now to FIG. 4 a schematic illustration is there shown of the hydraulic control and power system of the present invention. Typical rotary drilling rigs have an accumulator 194 located approximately two hundred feet from the drilling rig, which accumulator provides a source of clean hydraulic fluid under pressure. Typically a hydraulic pressure of approximately 1,500 psi is available. The accumulator 194 is used as the source of pressurized hydraulic fluid to power the power actuated valve 10 of the present invention. Four hydraulic lines 196, 198, 200 and 202 are connected to accumulator 194. Hydraulic lines 196 and 198 are connected to a first four-way valve 204, and hydraulic lines 200 and 202 are connected to a second four-way valve 206. The hydraulic lines or conduits 196, 198, 200 and 202 then exit the valves 204 and 206 and are connected to a manifold 208. The manifold 208 is attached to first frame means 72.

Hydraulic lines 196 and 198 then exit manifold 208 and are connected to hydraulic motor 162. The first four-way valve 204 includes three operating positions, namely a forward position, a reverse position, and a neutral position. In the forward and reverse positions the hydraulic motor 162 may be rotated in either direction so that the valve member 16 may be either opened or closed by the appropriate motion of the hydraulic motor 162.

A safety relief valve 210 is attached to hydraulic motor 162 so that the output torque of hydraulic motor 162 may be controlled by relieving the hydraulic pressure within the motor 162 if that pressure exceeds a predetermined level.

In FIG. 4 the four lift cylinders 92 and the one locking cylinder 166 are schematically illustrated. All of those cylinders are double acting cylinders and the hydraulic lines 200 and 202 exit manifold 208 and each run to each of the cylinders 92 and 166. All five of the cylinders are connected in parallel, as shown in FIG. 4, so that when the four-way valve 206 is placed in one position all the cylinder pistons 96 and the piston 170 are extended so that plunger means 172 is engaged with locking ring 54 at the same time at which the pistons 96 are extended thereby causing second gear 48 to be engaged with first gear 22. In that manner the parallel hydraulic circuit provides a control means, operatively associated with the lift cylinders 92 and the plunger cylinder 166 for causing the plunger means 172 to be engaged with the locking ring 54 at the same time at which the second gear means 48 is engaged with the first gear 22. Similarly when the second four-way valve 206 is placed in the opposite position, all of the pistons 96 and the piston 170 are caused to retract at the same time.

Thus, the power actuated valve of the present invention is well adapted to obtain the ends and advantages mentioned as well as those inherent therein. While presently preferred embodiments of the invention have been described for the purpose of this disclosure, numerous changes in construction and arrangement of parts can be made by those skilled in the art, which changes are encompassed in the spirit of this invention as defined by the apended claims.

What is claimed is:

1. An actuator for a valve, said valve including a valve body having a valve member disposed in said valve body with a first gear attached to said valve member, said actuator comprising:

a second gear means for drivingly engaging said first gear to operate said valve;

moving means for selectively moving said second gear means into and out of engagement with said first gear;

power means for driving said second gear means;

support member means constructed for attachment to said valve body;

first frame means, rotatingly connected to said support member means so that said valve body may rotate relative to said frame means, said frame means also being attached to said moving means; and locking means for selectively locking said frame means to said support member means prior to operating said valve to prevent said support member means from rotating relative to said frame means.

2. The actuator of claim 1, wherein said locking means includes:

a locking ring, attached to said support member means, said locking ring having a plurality of holes disposed therein, said holes being located on a circle concentrically disposed about an axis of rotation of said support member means; and plunger means, connected to said frame means, for selectively engaging and disengaging one of said holes in said locking ring.

3. The actuator of claim 2, further comprising control means, operatively associated with said moving means and said plunger means, for causing said plunger means to be engaged with said locking ring at the same time at which said second gear means is engaged with said first gear.

4. The actuator of claim 3, wherein:

said moving means includes a first hydraulic cylinder connected between said first frame means and said second gear means;

said plunger means includes a second hydraulic cylinder operatively associated with said first frame means; and said control means includes a parallel hydraulic connection from a source of hydraulic fluid under pressure to said first and second hydraulic cylinders.

5. The actuator of claim 2, wherein:

said holes in said locking ring have a tapered edge on a surface of said locking ring facing said plunger means, with tapered edges of adjacent holes intersecting; and said plunger means includes a tapered locking ring engaging end so constructed that engagement of said tapered engaging end with one of said tapered edges causes relative rotation between said plunger means and said locking ring until said tapered engaging end of said plunger means is received in one of said holes.

6. The actuator of claim 1, further comprising:

a second frame means attached to said moving means so that said moving means moves said second frame means relative to said first frame means; and wherein said second gear means is connected to said second frame means.

7. The actuator of claim 6, wherein:

said second frame means is further characterized as being an annular frame means constructed to be disposed about said valve body; and said second gear means is further characterized as being a ring gear concentrically rotatingly connected to said second annular frame means.

8. The actuator of claim 7, wherein:

said actuator further comprises a third gear means, said third gear means being a straight ring gear concentrically attached to said second gear means; and said power means includes a motor attached to said first frame means, said motor being drivingly attached to a fourth gear means which is a straight pinion gear, said pinion gear having a tooth length sufficient to allow said pinion gear and said straight ring gear to remain meshed when said second gear means is not engaged with said first gear of said valve.

9. The actuator of claim 1, further comprising control means, operatively associated with said moving means and said locking means, for causing said locking means to lock said frame means to said support member means at the same time at which said second gear means is engaged with said first gear.

10. A power actuated valve, comprising:

a valve body;

a valve member disposed in said valve body;

a first gear means attached to said valve member;

a second gear means for drivingly engaging said first gear means to operate said valve;

moving means for selectively moving said second gear means into and out of engagement with said first gear means;

power means for driving said second gear means;

first frame means attached to said moving means, said first frame means being rotatingly connected to said valve body so that said valve body may rotate relative to said frame means; and locking means for selectively locking said frame means to said valve body prior to operating said valve to prevent said frame means from rotating relative to said valve body.

11. The valve of claim 10, wherein said locking means includes:

a locking ring, connected to said valve body, said locking ring having a plurality of holes disposed therein, said holes being located on a circle concentrically disposed about an axis of rotation of said valve body; and plunger means, connected to said frame means, for selectively engaging and disengaging one of said holes in said locking ring.

12. The valve of claim 11, further comprising control means, operatively associated with said moving means and said plunger means, for causing said plunger means to be engaged with said locking ring at the same time at which said second gear means is engaged with said first gear.

13. The valve of claim 12, wherein:

said moving means includes a first hydraulic clyinder connected between said first frame means and said second gear means;

said plunger means includes a second hydraulic cylinder operatively associated with said first frame means; and said control means includes a parallel hydraulic connection from a source of hydraulic fluid under pressure to said first and second hydraulic cylinders.

14. The valve of claim 11, wherein:

said holes in said locking ring have a tapered edge on a surface of said locking ring facing said plunger means; and said plunger means includes a tapered locking ring engaging end so constructed that engagement of said tapered engaging end with one of said tapered edges causes relative rotation between said plunger means and said locking ring until said tapered engaging end of said plunger means is received in one of said holes.

15. The valve of claim 10, further comprising:

a second frame means attached to said moving means so that said moving means moves said second frame means relative to said first frame means; and wherein said second gear means is connected to said second frame means.

16. The valve of claim 15, wherein:

said second frame means is further characterized as being an annular frame means concentrically disposed about an axis of rotation of said valve body; and said second gear means is further characterized as being a ring gear concentrically rotatingly connected to said second annular frame means.

17. The valve of claim 16, wherein:

said valve further comprises a third gear means, said third gear means being a straight ring gear concentrically attached to said second gear means; and said power means includes a motor attached to said first frame means, said motor being drivingly attached to a fourth gear means including a straight pinion gear, said pinion gear having a tooth length sufficient to allow said pinion gear and said straight ring gear to remain meshed when said second gear means is not engaged with said first gear of said valve.

18. The valve of claim 15, wherein:

said first gear means includes a bevel gear; and said second gear means includes a bevel ring gear.

19. The valve of claim 10, further comprising control means, operatively associated with said moving means and said locking means, for causing said locking means to lock said frame means to said valve body at the same time at which said second gear means is engaged with said first gear.

20. An actuator for a kelly valve, said valve including a cylindrical vertically oriented valve body having a valve member disposed in said valve body with a first gear attached to said valve member, said valve body being adapted to be attached to a drill string for rotation therewith to provide a means for closing said drill string, said actuator comprising:

support member means constructed for attachment to said cylindrical valve body for rotation therewith;

frame means, rotatingly connected to said support member means and constructed to be disposed about said cylindrical valve body so that said cylindrical valve body may rotate within said frame means while said frame means is held stationary;

a second gear means for drivingly engaging said first gear to operate said valve member;

moving means, attached to said frame means so as to be held stationary therewith upon rotation of said cylindrical valve body, and operatively associated with said second gear means for selectively moving said second gear means into and out of engagement with said first gear; and power means, attached to said frame means so as to be held stationary therewith upon rotation of said cylindrical valve body, and operatively associated with said second gear means, for driving said second gear means.

21. A power actuated kelly valve, comprising:

a cylindrical valve body adapted to be attached to a drill string for rotation therewith;

a valve member disposed in said cylindrical valve body;

a first gear attached to said valve member;

frame means, disposed about said cylindrical valve body and rotatingly connected thereto so that said cylindrical valve body may rotate within said frame means while said frame means is held stationary;

a second gear means for drivingly engaging said first gear to operate said valve member;

moving means, attached to said frame means so as to be held stationary therewith upon rotation of said cylindrical valve body, and operatively associated with said second gear means for selectively moving said second gear means into and out of engagement with said first gear; and power means, attached to said frame means so as to be held stationary therewith upon rotation of said cylindrical valve body, and operatively associated with said second gear means, for driving said second gear means.

* * * * *